US009586308B2

(12) United States Patent
Banuelos et al.

(10) Patent No.: US 9,586,308 B2
(45) Date of Patent: Mar. 7, 2017

(54) ABRASIVE PRODUCT COATED WITH AGGLOMERATED PARTICLES FORMED IN SITU AND METHOD OF MAKING THE SAME

(71) Applicant: Fabrica Nacional de Lija, S.A. de C. V., Tlalnepantla (MX)

(72) Inventors: Alfredo Banuelos, Tecamac (MX); Dario Alarcon, Gustavo A. Madero (MX); Hector F. Medel, Tlalnepantla de Baz (MX); Octavio A. Rostro, Tlalnepantla de Baz (MX)

(73) Assignee: FABRICA NACIONAL DE LIJA, S.A. DE C.V., Tlalnepantla, Estado de Mexico (MX)

( * ) Notice: Subject to any disclaimer, the term of this patent is extended or adjusted under 35 U.S.C. 154(b) by 45 days.

(21) Appl. No.: 14/532,670

(22) Filed: Nov. 4, 2014

(65) Prior Publication Data

US 2015/0290773 A1 Oct. 15, 2015

Related U.S. Application Data

(60) Provisional application No. 61/977,362, filed on Apr. 9, 2014.

(51) Int. Cl.
*B24B 1/00* (2006.01)
*B24D 3/00* (2006.01)
(Continued)

(52) U.S. Cl.
CPC ..... *B24D 11/001* (2013.01); *B24D 11/005* (2013.01)

(58) Field of Classification Search
USPC ..... 51/295, 293, 307, 309
See application file for complete search history.

(56) References Cited

U.S. PATENT DOCUMENTS 2,115,897 A 5/1938 Wooddell et al.
2,242,877 A 5/1941 Albertson
(Continued)

*Primary Examiner* — James McDonough
(74) *Attorney, Agent, or Firm* — Law Office of Walter R. Brookhart; Walter R. Brookhart

(57) ABSTRACT

The present invention relates to a coated abrasive article containing abrasive agglomerates based on target cores that provide an extended surface. Target cores are defined as geometric shapes, e.g., spherical, rectangular, tetrahedral, conical, cylindrical, pyramidal or combinations and mixtures thereof. The preferred cores are porous structures with their own abrasive capacity as a grinding aid element. They are bonded on substrates, e.g., textile fabrics, plastic films, saturated or no treated papers, vulcanized fibers, non-wovens and mixtures thereof to produce extended surfaces on which are deposited the working abrasive particles, e.g., aluminum oxide, silicon carbide, zirconia alumina, ceramic aluminum oxide and mixtures thereof, through an electrostatic field to improve performance capabilities. The electrostatic field promotes orientation of the deposited grains around the cores with exposed sharp edges over the extended area, causing as a secondary effect the compacting of the abrasive grains. The abrasive grains are agglomerated in situ via nucleation of the surface of the target cores during the coated abrasive manufacturing process. Incorporation of the abrasive particles on the interstices between target cores also produces increased life of the coated abrasive article. The invention includes the method of manufacturing the abrasive article by forming the agglomerated particles in situ during the manufacturing process.

32 Claims, 9 Drawing Sheets

(51) Int. Cl.

| | |
|---|---|
| ***B24D 11/00*** | (2006.01) |
| ***B24D 18/00*** | (2006.01) |
| ***C09K 3/14*** | (2006.01) |

(56) References Cited

U.S. PATENT DOCUMENTS

| | | | | |
|---|---|---|---|---|
| 2,755,607 | A | 7/1956 | Haywood | |
| 3,048,482 | A | 8/1962 | Hurst | |
| 3,916,584 | A | 11/1975 | Howard et al. | |
| 3,918,217 | A | 11/1975 | Oliver | |
| 3,928,949 | A | 12/1975 | Wagner | |
| 4,132,533 | A | 1/1979 | Lohmer et al. | |
| 4,311,489 | A | 1/1982 | Kressner | |
| 4,541,842 | A | 9/1985 | Rostoker | |
| 4,652,275 | A | 3/1987 | Bloecher et al. | |
| 4,799,939 | A | 1/1989 | Bloecher et al. | |
| 5,039,311 | A | 8/1991 | Bloecher | |
| 5,219,462 | A | 6/1993 | Bruxvoort et al. | |
| 5,437,754 | A | 8/1995 | Calhoun | |
| 5,578,098 | A | 11/1996 | Gagliardi et al. | |
| 5,681,217 | A | 10/1997 | Hoopman et al. | |
| 5,928,394 | A | 7/1999 | Stoetzel | |
| 5,975,988 | A | 11/1999 | Christianson | |
| 6,299,508 | B1 | 10/2001 | Gagliardi et al. | |
| 6,790,126 | B2 | 9/2004 | Wood et al. | |
| 6,797,023 | B2 * | 9/2004 | Knapp | B24D 3/04 428/323 |
| 7,410,413 | B2 * | 8/2008 | Woo | B24D 11/001 451/527 |
| 2009/0139149 | A1 * | 6/2009 | Sachse | C09K 3/1436 51/298 |
| 2010/0003904 | A1 * | 1/2010 | Duescher | B24B 37/14 451/259 |
| 2011/0056142 | A1 * | 3/2011 | Sheridan | B24D 18/00 51/295 |
| 2013/0280995 | A1 | 10/2013 | Dopp et al. | |

* cited by examiner

ABRASIVE PRODUCT COATED WITH AGGLOMERATED PARTICLES FORMED IN SITU AND METHOD OF MAKING THE SAME

BACKGROUND OF THE INVENTION

I. Technical Field of the Invention

This invention relates to a coated abrasive and more particularly to coated abrasives containing abrasive agglomerates made in situ through target cores with a preferred distribution. The abrasive particles are oriented with sharp edges all over the cores which create extended surfaces for improving the abrading capacity of the abrasive articles.

II. Description of the Background

Coated abrasives typically consist of a single layer of abrasive grain adhered to a backing. It has been found that not more than about 15% of the grains of abrasive are utilized in removing material from any workpiece. Thus, about 85% of the grains are wasted (U.S. Pat. No. 5,039,311 Bloecher et al.). To overcome this problem of waste the industry is continuously seeking to extend the life of coated abrasive products.

In efforts to extend the life of coated abrasive products, various studies have been made to achieve a distribution of the abrasive particles on the substrate so that the majority of particles are used. For example, U.S. Pat. No. 2,115,897 (Wooddell et al.) describes a coated abrasive article comprising a flexible band made of a plurality of blocks of bonded abrasive material attached to the band by a resin layer forming a pattern.

U.S. Pat. No. 2,242,877 (Albertson) describes the production of coated abrasives in the form of abrasive discs with different patterns produced with different layers of abrasive particles.

U.S. Pat. No. 2,755,607 (Haywood) describes the production of a coated abrasive with a uniform pattern of grooves or indentations in the abrasive surface. The pattern is provided by the deposition of an adhesive by a roller coating operation. The adhesive layer, while still wet or in a softened condition, is shaped into a series of parallel, narrow-width groove portions which alternate with a parallel series of land portions appreciably thicker than the groove portions without breaking the continuity of the adhesive layer.

U.S. Pat. No. 3,048,482 (Hurst) describes the manufacture of a novel type of abrasive article, comprising a flexible support of backing to which is affixed an abrading body made up of a multiplicity of individual small abrasive bodies. Each of these bodies is roughly pyramidal in shape and comprised of discrete abrasive granules. A rigid, heat-hardened, organic bond is produced using an adhesive selected from the group consisting of heat-hardened, phenolic resins and vulcanized hard rubbers.

U.S. Pat. No. 3,916,584 (Howard et al.) describes a spheroidal composite particle comprising about 6-65% by volume of fine abrasive grains having a Knoop hardness of at least about 1500 and an effective diameter on the order of 25 microns or less. In a preferred method of manufacture, the abrasive grains are dispersed in a metal oxide gel, the gel is dehydrated to leave spheroidal composite granules and the granules are heated to drive off remaining water.

U.S. Pat. No. 3,918,217 (Oliver) describes cutting and abrading devices made with special predetermined protrusions armed with metal bonded refractory metal grit. The abrading tool structure comprises a plurality of spherical steel shot particles forming protrusions and magnetically-oriented, abrasive grit particles. A metal bonding material holds the abrasive grit particles and steel shot particles in proper position. The ratio of protrusion to grain size should be 1 to 3. The deposition of abrasive could be in either a single layer or a pyramidal arrangement.

U.S. Pat. No. 3,928,949 (Wagner) describes a grinding material comprising a multiplicity of hollow bodies whose walls contain abrasive grains on more than 50% of the wall surface with a bonding means selected from the group consisting of synthetic resins. The diameter of the hollow bodies is between 0.1 and 8 mm and is not more than 50 times the mean grain diameter. The abrasive grains are contained substantially within the walls of the hollow bodies.

U.S. Pat. No. 4,132,533 (Löhmer et al.) describes a process for producing abrasives in the form of hollow spheres, wherein abrasive grains are anchored on a thermoplastic, spherical supporting surface by heating. The diameter of the thermoplastic, spherical supporting surface is from 0.5 to 6 mm, with abrasive grains from 63 to 150 microns in size.

U.S. Pat. No. 4,311,489 (Kressner) describes a coated abrasive product having a solid agglomerate of fine abrasive grains having an average diameter less than about 200 microns and an inorganic, brittle, cryolite matrix. The agglomerates have an irregular surface producing a strong bond to the matrix and size coats which permit gradual wearing down of the agglomerates during grinding by gradual removal of dulled abrasive grains from the agglomerates. The matrix bond serves to limit the depth of penetration into the workpiece of the individual abrasive grains during the grinding action and thereby provides a surface finish comparable to the surface finish utilizing unagglomerated abrasive grains of the grit size of the individual grains in the agglomerates.

U.S. Pat. No. 4,551,842 (Rostoker) describes abrasive agglomerate particles comprising a matrix of multi-cellular foamed glass with abrasive grit particles encapsulated within the cell walls of the glass. The agglomerates have a spherical shape. Unfortunately, the results of this invention show no reproducibility or consistency.

U.S. Pat. No. 4,652,275 (Bloecher et al.) describes an abrasive article comprising erodible agglomerates formed by a multiplicity of individual grains of abrasive mineral. The agglomerates contain about 60 to about 95 weight percent individual abrasive grains and about 0.3 to about 8 weight percent matrix material. The final size of the agglomerates was about 20 to about 100 microns.

U.S. Pat. No. 4,799,939 (Bloecher et al.) describes erodable agglomerates containing individual abrasive grains disposed in an erodable matrix comprising hollow bodies and a binder. The hollow bodies preferably comprise hollow microspherical particles formed from glass. The size of the agglomerates range from 150 to 3000 microns.

U.S. Pat. No. 5,039,311 (Bloecher) describes an erodable abrasive granule comprising an erodable base agglomerate formed by a plurality of first abrasive grains in a binder and a coating comprising a plurality of second abrasive grains bonded to at least a portion of the base agglomerate. The second abrasive grains are larger than the first abrasive grains.

U.S. Pat. No. 5,219,462 (Bruxvoort et al.) describes an abrasive article that has abrasive composite members secured firmly in recesses in a backing sheet in a precise pattern to produce a desired lateral spacing between each abrasive composite member. The composite members are produced through the back concentrated in patterns with grooves which are filled by means of an abrasive mixture including blowing agents in which heat increases its size and forms abrasive protrusions.

U.S. Pat. No. 5,437,754 (Calhoun) describes a method of forming an abrasive article comprising the steps of providing an embossed carrier web having a plurality of recesses formed in the front surface thereof and filling the recesses with an abrasive composite slurry having a plurality of abrasive grains dispersed in a hardenable precursor.

U.S. Pat. No. 5,578,098 (Gagliardi et al.) describes a coated abrasive article comprising a backing of erodible agglomerates and abrasive grains on at least one major surface thereof. The erodible agglomerates consist essentially of a grinding aid and the erodible agglomerates are in the form of rods. The agglomerates may also be dispersed between, above or both between and above the abrasive grains.

U.S. Pat. No. 5,681,217 (Hoopman et al.) describes an abrasive article comprising a sheet-like structure including a major surface extending within a first imaginary plane with a plurality of individual, three-dimensional abrasive composites dispersed in fixed positions thereto in an array. Each of these composites comprises abrasive particles dispersed in a binder. Each of these composites has a substantially precise shape characterized by a distal end extending farthest from the major surface, so that the composites comprise a geometrical shape having a first portion in contact with the major surface and a second portion as an outer end. The first portion comprises a frusto-conical shape, while the second portion comprises a rounded shape.

U.S. Pat. No. 5,928,394 (Stoetzel) describes an abrasive article containing an abrasive coating having more than one abrasive composite layer. Stoetzel also describes a method of manufacturing which forms a defined pattern such as a pyramid. Such a pattern is constructed of abrasive slurries deposited on one another to form the defined shape, where each abrasive slurry may contain different abrasive particles with the same or different size and different adhesives.

U.S. Pat. No. 5,928,394 (Christianson) describes a coated abrasive article comprising abrasive agglomerates in the shape of a truncated four-sided pyramid. Also described is a method of making the coated abrasive article consisting of making the agglomerate by molds and subsequently depositing them on a substrate to produce the coated abrasive.

U.S. Pat. No. 6,299,508 (Gagliardi) describes an abrasive article comprising a base layer having both a first surface and a second surface, and a plurality of protrusions comprising grinding aids integrally molded with the base layer. The first surface of the base layer is contoured by the protrusions to define a plurality of peaks and valleys. A coating of abrasive particles is adhered to the contoured first surface to cover at least a portion of both the peaks and the valleys.

U.S. Pat. No. 6,790,126 (Wood et al.) describes agglomerate abrasive grains comprising a plurality of abrasive particles bonded together with a sintered, crystalline, ceramic bonding material. The bonding material comprises, on a theoretical oxide basis, at least 50 percent by weight crystalline $Al_2O_3$, based on the total metal oxide content of the bonding material. The abrasive particles have an average particle size of at least 5 micrometers.

U.S. Pat. No. 6,797,023 (Knapp et al.) describes coated abrasives comprising abrasive agglomerate grains characterized by a high porosity and low ratio of solid volume to nominal volume which provide an exceptionally useful medium for low pressure grinding characteristics. The method for obtained the agglomerate abrasive grains employs a rotary dryer which incorporates a partially agglomerated abrasive mixture of synthetic resins and inorganic fillers introduced to a rotary dryer. The temperature is raised above 500° C. to calcine all organic material so that the space occupied by this material serves as the abrasive agglomerate porosity and so that the inorganic filler melts and serves as a binding agent.

U.S. Pat. No. 7,410,413 (Woo et al.) describes a structured abrasive article comprising a backing having first and second opposed major surfaces and a structured abrasive layer having an outer boundary and affixed to the first major surface of the backing. The structured abrasive layer comprises a plurality of raised abrasive regions. Each raised abrasive region consists essentially of close-packed, pyramidal abrasive composites having a first height and a network consisting essentially of close-packed, truncated, pyramidal abrasive composites having a second height. The network continuously abuts and separates the raised abrasive regions from one another and is coextensive with the outer boundary.

U.S. Pat. Application Ser. No. 2009/0139149 A1 (Sachse) describes an abrasive grain with a core of melted spherical corundum characterized by the spherical corundum being coated with a layer of at least one binder and fine-grained, abrasive solid particles. The agglomerate size is a medium diameter ranging from 0.5 to 5 mm, while the size of the abrasive grains ranges from 50 to 500 microns. The agglomerate grain is used for bonded abrasives.

U.S. Pat. Application Ser. No. 2011/0056142 A1 (Sheridan) describes methods for forming aggregate, abrasive grains for use in the production of abrading or cutting tools. The method comprises providing abrasive core particles; coating these particles with an adhesive, the adhesive comprising a binding agent and a solvent for the binding agent; separately dropping the adhesive-coated core particles onto a layer of abrasive peripheral particles and covering the dropped core particles with further peripheral particles, in such way as to form aggregate particles, each of which comprises a core particle having peripheral particles attached to it; and consolidating the aggregate particles by causing the solvent to evaporate by letting the adhesive set.

U.S. Pat. Application Ser. No. 2013/0280995 A1 (Dopp et al.) describes an abrasive having a base body with abrasive particles applied to its surface wherein the base body has a multi-cellular structure. Glass is used for the multi-cellular base bodies.

As seen above, most of the approaches taken by the industry and by those skilled in the art to increase the life of the coated abrasive focus on obtaining a coated abrasive with abrasive agglomerates and/or defined patterns. The majority of these patents involve additional processes for manufacturing the agglomerated abrasive particles, using in most cases different machines and requiring high temperatures above 300° C. which involve high energy costs and an excessive number of process steps.

While pattern formation in most of these prior methods involves abrasive slurries, the coated abrasives produced by these methods do not produce abrasive with defined grain orientation for the abrading process. New edges are randomly distributed into the agglomerate together with the resin binders and fillers.

In most of the methods described in the above patents, parts of the agglomerates are flooded by the resin binders in order to affix them to the selected backing. These abrasive portions do not work and are considered as a foundation base to avoid shelling during the sanding process. These portions may also be considered as wasted materials, because no abrasive benefits are obtained from them.

Thus, there has been a long-felt, but unfulfilled need for improved, coated abrasive materials and for methods of producing such materials without requiring additional process stops and equipment. Further, there has been a continuing need for coated abrasive materials where the abrasive particles are oriented to produce consistent abrasion and extended useful life during the abrading process.

SUMMARY OF THE INVENTION

The present invention describes the production of a coated abrasive material made with agglomerated particles produced in situ over target cores performing as extended surfaces. The agglomeration process is carried out within the same manufacturing process of the coated abrasive, but incorporating an additional process step without requiring additional equipment, while ensuring that all the abrasive particles are oriented for their maximum use during the abrading process.

The present invention provides a coated abrasive material based on agglomerated particles which are produced in situ by nucleation and have defined geometric shapes with porous cores called target cores. These cores have four main functions:

The first function is to be the nucleation center for producing the agglomerated abrasive. The second function is to provide a porous center which is able to fracture during use over the lifetime of the product to produce new edges for the abrasive grains deposited on its periphery and exposing the new abrasives deposited in the interstices left between them.

The third function is to provide a core that simultaneously serves as an abrasive particle due to its chemical composition and that contributes to the grinding process of the work pieces. The fourth function is to have a heat release capacity due to the porous center, therefore, giving it a working temperature typically lower than conventional mono-layer, coated abrasives obtained by conventional processes. Further, the material removed during the grinding process has a place to be deposited so that the coated abrasive article does not become loaded and is able to maintain its abrading capacity.

The target cores have defined geometric shapes such as spherical, cylindrical, cubic, conical, rectangular, tetrahedral and other polyhedral structures and have a porous structure with their own abrasive capacity to act as a grinding aid element. The target cores should have a hardness preferably greater than or equal to about 4 on the Mohs scale. The abrasive grains used for the present invention can be any abrasive particle having a hardness preferably greater than or equal to about 7 on the Mohs scale. Non-limiting examples of such particles include aluminum oxide, zirconium oxide, ceramic aluminum oxide, silicon carbide, diamond, cubic boron carbide, iron oxide, and mixtures thereof.

The target cores may be from about 50 to about 5000 microns. The abrasive grains may be from about 3 to about 2000 microns. The abrasive grains must be smaller that the target cores, preferably in a ratio from about 1 to about 3 (size of target cores to size of abrasive particles) in order to optimize their distribution on the surface of the target cores and so that they can be incorporated in the interstices between the target cores. The specific sizes are selected based on the final product requirements.

The deposition of abrasive grains onto the cores (target core particles) and between their interstices is achieved in both traditional ways well known in the coated abrasives manufacturing industry, e.g., either gravity, electro-projection or both. Preferably deposition is by electro-projection, so the abrasive particles remain with their sharp edges oriented to produce a greater distribution on the surface of the cores and an increased incorporation over the cavities left between each core. An article so produced shows both an extended life when compared to a conventional coated abrasive and a more uniform scratch profile.

The manufacturing method for the production of coated abrasives of the present invention is simple, efficient and easy to adopt, because there is no need for acquiring more costly process equipment. The present invention uses the same process machine used for the production of mono-layer, coated abrasives and requires only the addition of a simple, extra step during the manufacturing process.

In the method of the present invention, an adhesive (the pre-make coat) is deposited on a backing by a rubber/steel roll coating method, followed by deposit of the porous body particles (the target cores) via gravity or electrostatic core projection. After the adhesive with the core particles has dried, a second adhesive layer (the make coat) is applied over the core particles and backing in a second step followed by the immediate deposit of the abrasive particles either by gravity or electro-projection.

The adhesive layers for the pre-make, make, size and supersize coatings are selected from conventional adhesives, including the phenolic resins, epoxy resins, urea formaldehyde resins, polyester resins, polyurethane resins, acrylic resins and blends thereof.

Subsequently, the adhesive is dried in conventional festoon ovens to allow the abrasive grains to be properly set on the article. The final step is the deposit of a third adhesive layer (the size coat) on the abrasive particles in order to hold them and to avoid grain shelling during product use. Another optional step is the deposit of a top coat (super size coat) which may comprise grinding aids, e.g., resin blends to assist the grinding process, when the abraded material is stainless steel.

Chemicals commonly used as grinding aids may include the inorganic salts of the elements of Group III of the Periodic Table including the halides, e.g., potassium tetrafluoroborate ($KFB_4$), cryolite ($Na_3AlF_6$) and others.

The coated abrasives produced by this invention may be used in different final forms, including cloth or paper abrasive belts, vulcanized fiber discs, abrasive sheets and strips, cloth or paper abrasive discs, non-woven belts and discs and the like.

Thus, the long-felt, but unfulfilled need for improved, coated, abrasive materials and efficient methods for producing such materials without requiring additional, energy-intensive steps and equipment has been met. These and other meritorious features and advantages of the present invention will be more fully appreciated from the following detailed description and claims.

BRIEF DESCRIPTION OF THE DRAWINGS

Other features and intended advantages of the present invention will be more readily apparent by references to the following detailed description in connection with the accompanying drawings wherein.

Figure 1:
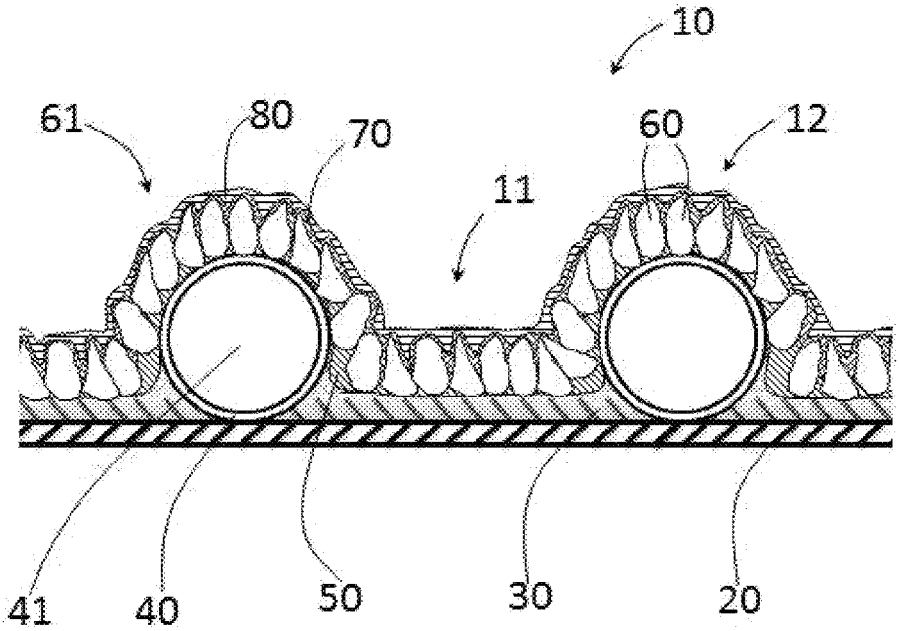
FIG. 1 is a cross-sectional view of a coated abrasive of the present invention.

While the invention will be described in connection with the presently preferred embodiments, it will be understood that it is not intended to limit the invention to those embodiments. On the contrary, it is intended to cover all alternatives, modifications and equivalents as may be included in the spirit of the invention as defined in the appended claims.

DETAILED DESCRIPTION OF THE INVENTION

Abrasive Article

The abrasive products manufactured based on this invention have an extended or longer working life than conventional single-grain, layer-coated abrasives as a result of the use of multi-grains exposed on extended areas. The extended abrasion life is the result of three main features: (1) extended areas (target cores) where the abrasive particles have been set; (2) increased numbers of abrasive particles that have been agglomerated by over exposition time of those target cores in the electrostatic field; and (3) increased core abrasion capacity of the target cores.

According to the present invention, the coated abrasive comprises porous cores providing extended areas whose walls form the bases for the abrasive particles. Resin binders promote proper adhesion to support and give the product resistance during the grinding process. When first used, the agglomerated cores with the abrasive particles begin their grinding action with the outer, top, sharp edges. Over time wear exposes more fresh cutting edges. Thus, coated abrasive articles of the present invention exhibit an extended lifetime at least two or three times longer than a conventional coated abrasive, as a result of the construction methods of the present invention which are described below.

DEFINITIONS

"Target cores" refers to particles with defined geometric shapes, e.g., spherical, cubical, rectangular, tetrahedral, conical, cylindrical, pyramidal or combinations and mixtures thereof. These particles may also be porous structures with their own abrasive capacity.

"Extended surface" defines the area gained from the addition of the target cores on the backing.

"In situ" means that the agglomerate particles are formed during and as part of the manufacturing process of the coated abrasive.

"Nucleation" refers to the process by which the abrasive particles are deposited on the surface of the target cores causing the agglomeration of the abrasive particles.

"Binder precursor" is defined as the resinous-type material that has not been totally polymerized and may comprise one or more additives.

"Curing and polymerization" are used interchangeably and defined as the increase in molecular weight of the modified thermosetting binder so that the modified thermosetting binder forms a network.

Backing

The backing in the present invention may be selected based on the final use or application of the coated abrasive product. The backing is selected from conventional backings well known to those skilled in the art. The backing may be selected from treated textile fabrics of different flexibilities, thickness and smoothness. The backing may be made from natural or synthetic yarns like cotton, polyester cotton, polyester, nylon, rayon or blends thereof. Other suitable backings include vulcanized fibers, non-wovens, papers, saturated papers, polymeric extruded films, polymeric foams, paper/cloth combinations, mesh, stitch-bonded and combinations thereof.

In most of the cases the textile fabrics have been treated with acrylic latexes and synthetic resins. Treatments are intended to seal the fabric and improve its physical properties, e.g., tensile strength, smoothness, porosity, elongation resistance, flexibility, stiffness or thickness. These treatments are well known to those skilled in the art. Examples are described in U.S. Pat. No. 3,787,273 (Okrepkie et al.) and U.S. Pat. No. 5,700,302 (Stoetzel et al.).

Finished cloth backings are also available in the market from companies like Gustav Ernstmeier Gmbh or AG Cilander.

Pre-Make, Make and Size Coats

The pre-make coat is intended to affix the target cores on the backing. The make coat is used to affix the abrasive particles on the target cores. And the size coat promotes the proper adhesion to all agglomerated particles.

The supersize or top coat, when used, is applied over the size coat in order to improve grinding capacity and heat release, particularly when the coated abrasive will be used to abrade stainless steel or heat sensitive alloys. This optional layer contains active fillers which are well known to those skilled in the art, e.g., those fillers broadly described in U.S. Pat. No. 5,221,295 (Zador) and U.S. Pat. No. 5,507,850 (Helmin).

The top coat may be comprised of non-active fillers used as anti-loading components. These fillers are also well known to those skilled in the art such as the fillers disclosed in the U.S. Pat. No. 4,988,554 (Peterson et al.).

The compositions of the pre-make coat, make coat, size coat and supersize coats comprise a liquid binder precursor based on either thermoset resins or radiation-curable resins. The preferred resins in this case are polymerizable organic structures that may include phenolic resins, urea formaldehyde resins, melamine formaldehyde resins, bis phenol epoxy resins, isocyanate extended polyesters and polyethers, moisture curable urethane resins, vinyl ethers and mixtures thereof.

The resol or novolac phenolic resins are well known as one of the best selections, because of their outstanding thermal properties and economical cost. Resol phenolic resins may have a molar formaldehyde to phenol ratio between about 1.0-2.5 to 1. Their choice will be a function of the desired molecular weight structure. Novolac phenolic resins may have a formaldehyde/phenol ratio from about 0.5-0.9 to 1. Examples of commercially available resins in the market with their suppliers include Fibrex or other types from Masisa Resins, several types of resins from Fenoresinas, Durez and Varcum from Occidental Chemicals Corp, Resinox from Monsanto Chemicals, Aerofenet & Aerotap from Ashland Chemicals and Ruthapen from Bakelite AG.

Urea formaldehyde and melamine formaldehyde resins may be used in the present invention. Such resins are well known to those skilled in the art and are commercially available in the market. Examples include Fibers 550 from Masnova Resinas and Ureic resins from Fenoresinas.

Melamine formaldehyde resins may be used in the present invention as methylated or partially methylated waterborne melamine resins such as Cymel 328-385-373 from Cytec Industries.

Epoxy resins based on bis phenol A or F and commercially available in the market may be used in the present invention. Examples include DER 331-332-334, DEN 428 from Dow Checmical Co, Epon 828-1004-1001 F from Shell Chemical Co, CHS 520 from Spolchemie.

Isocyanate extended polyesters and polyethers may also be used. Examples of commercially available resins in this category include CMD 6600-8400-8805 from Radcure Specialties.

Moisture curable liquid or hot melt urethane resins with 100% solids such as those available from Henkel or HB Fuller may be used in the present invention.

Target Cores

Target cores refers to the species which have defined geometric shapes, e.g., spherical, cylindrical, cubic, conical, rectangular, tetrahedral and other polyhedral structures and which have a porous structure with their own abrasive capacity to act as a grinding aid element. Target cores may also have different chemical composition, e.g., a-alumina or with different zirconia contents and mixtures thereof. The choice of the chemical composition and the type and size of the target core depends on the end use for the coated abrasive article. Examples of different types of target cores are shown in Table 1.

TABLE 1

| Type of operation | Type of target core | Chemical composition |
|---|---|---|
| Heavy cut | Rectangular, conical, cylindrical, pyramidal, mixtures thereof | Zirconia (93%), α-alumina (98%) purity and mixtures thereof |
| Medium cut | Rectangular, conical, cylindrical, pyramidal, mixtures thereof | Zirconia (93%), α-alumina (98%) purity and mixtures thereof |
| Finishing | Spherical, conical mixtures thereof | α-alumina (99%) purity |
| Polishing | Spherical | α-alumina 99% of purity, polyethylene, polypropylene, polystyrene, another polymer and mixtures thereof |
| Micro Finishing | Spherical | polyethylene, polypropylene, polystyrene another polymer and mixtures thereof |

The previous table is only for illustration and is not meant to be limiting in any way. Other target cores which might be used include those with different purity or composition of zirconia and alumina or with different chemical composition, e.g., silica, titanium dioxide, glass, micro natural stones, materials having a hardness of at least about 4 on Mohs scale and mixtures thereof.

Hollow alpha-alumina cores used in this invention are the preferred material, because they are lightweight, are heat and compression resistant, have a low thermal conductivity and have a high abrasion capacity when the agglomerated cores are broken by the sanding process itself. Examples of suitable target cores include commercially available Alodur® KKW, KKW Special and KKLS bubble alumina from Treibacher Schleifmittel Company. Other suitable examples include Duralum® AB, Duralum® AB LS and Durazon® CSB from Washington Mills Company.

The agglomerated cores of the present invention wear very uniformly in the grinding process at heavy or moderate loads without breaking into large lumps. Thus, each agglomerated core will have an extended life. The breakage of the cores during use exposes new abrasive grains which are located at the periphery of the target and in the valleys, further improving the life of the product.

The layout of the agglomerated cores produces enough space between adjacent cores (valley to peak height) to promote in a more efficient way the use of liquid lubricants or coolants to avoid or reduce clogging during the sanding process of soft metals like aluminum and other soft metal alloys. Other dry lubricants like zinc, calcium or lithium stearates may be used in an anti-clogging layer, if the coated abrasive will be used to remove old paints, enamel coatings, polyester resin coatings, acrylic resin coatings or any other polymeric coatings.

The spaces between agglomerated target cores in a semi-open coat distribution allow the use of heat-release chemicals or grinding aids called Top Coats, like potassium fluoroborate, cryolite or other active fillers. The use of these substances produces a cooler sanding process mostly for heat sensitive metals like stainless steel, titanium and others.

The target cores range in size from about 50 to about 5000 microns, more preferably from about 100 to about 2500 microns. The specific size will be selected based on the final product requirements. The size must also be selected based on the abrasive grain particle to be deposited and must always be larger than the abrasive particles. The size distribution should be as uniform as possible in order to optimize the final finish of the sanded material.

Abrasive Particles

Abrasive grains that are used in the present invention include: fused brown and white aluminum oxide, heat-treated aluminum oxide, silicon carbide, zirconia alumina, ceramic aluminum oxide, cubic boron nitride, garnet, gypsum, talc, calcium oxide, aluminum oxide, calcium silicate, glass bubbles, gypsum, talc, calcium oxide, aluminum oxide, calcium silicate, diatomaceous earths, materials having a hardness at least about 7 on Mohs scale and combinations thereof. High quality abrasive grains are available from Treibacher Schleifmittel GmbH, Washington Mills and many other producers.

Distribution and Patterns of Agglomerated Abrasive Particles

The abrasive products manufactured in accord with this invention have either a closed or an open coat distribution which is selected based upon their intended final use. If the pre-make coat is applied by gravure roll, the selected tool may have a variety of engraved cell patterns and bias angles in such way that the target cores and agglomerated abrasive particles will form shapes, e.g., replicated triangles, squares, polygons, circles, rhombuses and the like. The layout arrangement of particles also may be either random or specifically designed based upon the intended use of the abrasive article.

Fillers

Fillers to be used in the present invention include inorganic and organic materials that will improve the coating toughness, hardness, reduce backing porosity, increase binders solid contents, improve grinding capacity or optimize the abrasive coat. Fillers may be either non-active or active fillers.

Examples of non-active fillers include calcium carbonate, wolastonite, clays, gypsum, talc, calcium oxide, calcium silicate, limestone, silicas, glass fibers, feldspar, calcium sulfates, vermiculite, titanium dioxide and the like.

Examples of active fillers or inorganic grinding aids include potassium fluoroborate, cryolite, polyvinyl halides, polyvinyliden halide disclosed in U.S. Pat. No. 3,616,580 (Duwell et al.), chlorinated waxes disclosed in U.S. Pat. No. 3,676,092 (Halsey), polytrifluorochloroethylene disclosed in U.S. Pat. No. 3,869,834 (Mullin et al.) inorganic sulfur, cupric sulfide, molybdenum sulfide, potassium sulfate disclosed in U.S. Pat. No. 3,833,346 (Wirth); U.S. Pat. No. 3,868,232 (Sioui et al.); and U.S. Pat. No. 4,475,926 (Hickory).

Other Additives

Other additives may be used as part of the formulations in the present invention including colorants, lubricants, defoamers, anti-settling agents, wetting agents, dispersing agents and organic solvents. These components are used to adjust desired characteristics, e.g., viscosity, wetting and liquid mixtures flowability and to the coating resin mixes.

Defoamers that may be used with the present invention include BYK019 from BYK Chemie GmbH. Anti-settling and thickener agents may include OPTIGEL LX from Souther Clay Products Inc. Emulsifier agents may include ALKEST SP20 from Oxiteno-UNIVAR.

General Method of Manufacture

Two processes are involved in the production of coated abrasives: coating and finishing.

Coating Method

The manufacturing process is a continuous operation comprising the application of three (pre-make coat, make coat and size coat) or four (pre-make coat, make coat, size coat and super size coat) adhesive layers.

A pre-make coat comprising a first organic-based binder precursor is applied to a backing by any technique known to those skilled in the art. Suitable techniques include spray coating, roll coating, die coating, powder coating or knife coating. The pre-make coat affixes the target cores on the backing. The target cores are distributed by either electrostatic or gravity methods which are well known to those skilled in art. The target cores are preferably uniformly distributed. The resulting structure is then exposed to a first energy source, e.g., a heat, ultra-violet or electron beam source, to at least partially cure the first binder precursor to form a solid pre-make coat that does not flow. For example, the resulting structure can be exposed to hot air at temperatures from about 60° C. to about 150° C., preferably from about 70° C. to about 130° C.

After this first step a make coat comprising a second, organic-based binder precursor of the same or different composition from the first binder, is applied over the target cores by any conventional technique known to those skilled in the art, e.g., spray coating, roll coating, powder coating, slot die coating or curtain coating. After that the abrasive particles are electro-projected and/or applied by gravity and adhered in the make coat. In a presently preferred method, the abrasive grains can be passed into an electrostatic field where they become charged, one end of each grain becoming positive and the other negative. A negative electrode used in creating the electrostatic field attracts the positive end of the grain particle and repels the negative end, thus turning, aligning and applying the grain in an upright position on the backing to produce a uniform, sharp and aggressive abrasive surface. If a gravity system is selected instead of the electrostatic system, the abrasive grains fall in a controlled manner on the make-adhesive coated backing. The material thus processed can be coated in accord with the application needs in a closed or open coat.

The resulting structure is then exposed to a second energy source, e.g., a heat, ultra-violet or electron beam source, to at least partially cure the second binder precursor to form a solid make coat that does not flow. Following this operation, a size coat comprising a third, organic-based binder precursor, which may be the same or different from the first and second binders, is applied over the target cores by any conventional technique known to those of skilled in the art, e.g., spray coating, roll coating, powder coating, die coating or curtain coating. Finally, the resulting abrasive construction is exposed to a third energy source, e.g., a heat, ultra-violet or electron beam source, which may be the same or different from the other two energy sources. The top coat (an optional layer) may be applied by any conventional technique known to those skilled in the art, e.g., spray coating or roll coating, and then curing by applying sufficient thermal or radiation energy. Complete polymerization is achieved by subjecting the resulting coated abrasive rolls (Jumbos) to temperature in stationary ovens.

Finishing or Converting

As a result of the manufacturing process large size rolls of different widths and lengths called Jumbos are produced, on which the finishing process begins. These Jumbos are dried or cured before being conditioned to the proper moisture content for future processing into any required form. The Jumbo rolls are stored and then cut to final form, e.g., discs, rolls, belts and specialty forms.

EXAMPLES

Nomenclature

10 coated abrasive
11 valleys
12 peaks
20 backing
30 pre-make coat
40 target cores
41 porous center
50 make coat
60 abrasive particles
61 agglomerates
62 cell patterns
70 size coat
80 super size coat The following non-limiting examples will further illustrate the invention. The following abbreviations are used throughout:

| Designation | Material |
|---|---|
| RBAO | regular brown fused aluminum oxide abrasive |
| AZA | aluminum zirconia abrasive |
| BAO | bluish grey aluminum oxide abrasive |
| BSAO | brown fused aluminum oxide abrasive, semi-friable |
| WAO | white fused aluminum oxide abrasive |
| SiC | silicon carbide abrasive |
| CAO | sintered aluminum ceramic abrasive |
| $KBF_4$ | potassium tetrafluoroborate (98% pure) |
| RF | phenolic resin |
| $CaCO_3$ | calcium carbonate |
| CRY | cryolite |
| IO | red iron oxide |
| AL | sorbitan monolaurate (Alkest SP20) |
| SAA | spherical hollow alpha alumina |

Specific Procedure for Making an Abrasive Article of the Present Invention

Backing 20 is coated with pre-make coat 30. Target cores 40 are then drop-coated by gravity onto pre-make coat 30 and precured. Make coat 50 is applied over target cores 40, followed by deposit of abrasive particles 60 over the make coat. The resulting abrasive article 10 is then precured. Size coat 70 is applied over the abrasive grains and the partially cured make coat and pre-make coat, after which the pre-make coat, make coat and size coat are fully cured. Optionally, supersize coat 80 is applied over size coat 70, and then cured to produce a finally cured abrasive article 10. The abrasive article is then flexed.

Testing Procedures

Procedure for Testing Coated Abrasives (Belts)

Belts were produced from production rolls after post-curing and flexing processes, cut into sizes of 2"×132" and installed upon a floor backstand sander with the following characteristics: contact wheel diameter 14", contact wheel slot angle 45°, contact wheel hardness on surface 40 shore "A" for Examples 1 and 2 and Control A, contact wheel hardness on surface 90 shore "A" for Examples 3 to 8 and Controls B and C and sander speed 1740 rpm. Materials to be grinded: stainless steel and carbon steel work pieces of 1" diameter with a length of 1.0 meter. Pressure loads over the metal piece were 1.150 kg for Examples 1 and 2 and 2 kg for Examples 3 to 8.

The abrasive belt cut efficiency or stock removal by abrading period is determined by weighing the work piece before and after each abrading period of 2.5 minutes to quantify the weight of metal that has been removed. The test is continued until there is no difference between the weight of the material before and after an abrading period at which point it is terminated. The abrasive belt life is determined by the sum of the number of periods achieved during the test.

FIG. 1 is a cross-sectional side view of coated abrasive 10 of the present invention showing backing 20 with pre-make coat 30 linking target cores 40 with porous centers 41. Also seen is make coat 50 with abrasive particles 60 and agglomerates 61 produced in situ and covered with size coat 70 and supersize coat 80.

Figure 2:
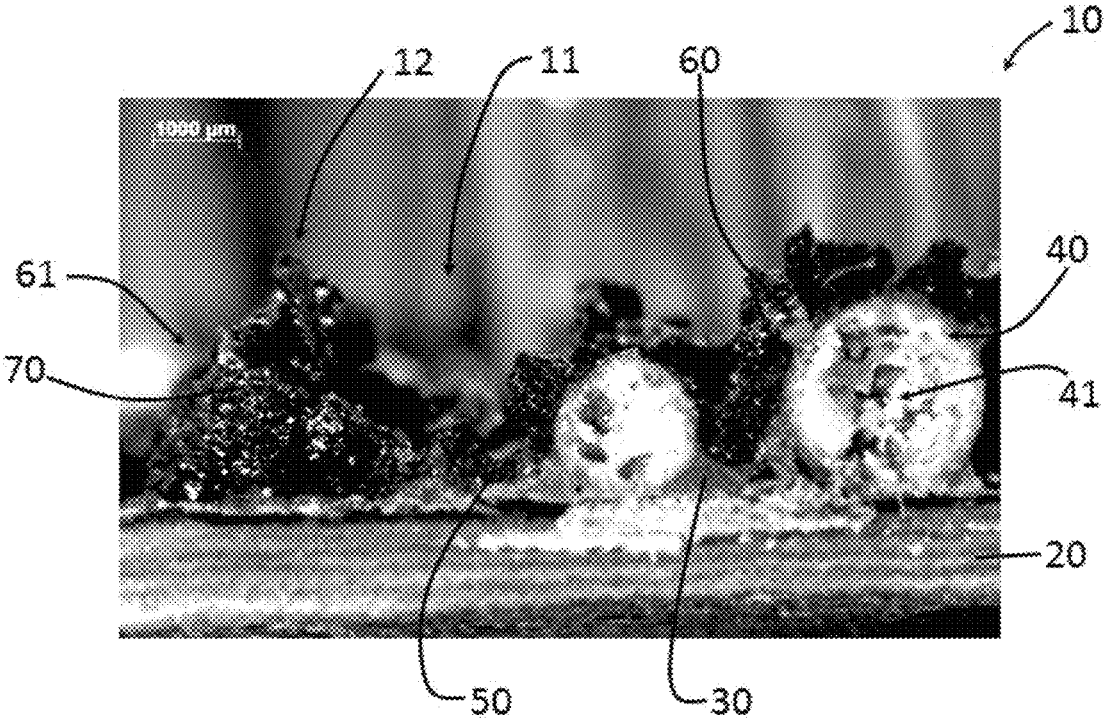
FIG. 2 is an optical photomicrograph profile showing a coated abrasive article of the present invention with agglomerated abrasive particles made by nucleation of the target cores, both partially and fully covered, and also showing the porous center core.

FIG. 2 is an optical photomicrograph profile obtained from coated abrasive 10 of the present invention showing porous centers 41 of target cores 40, abrasive particles 60 deposited in valleys 11 and peaks 12 between each core 40, and agglomerates 61 produced in situ using conventional coated abrasive manufacturing equipment.

Figure 3:
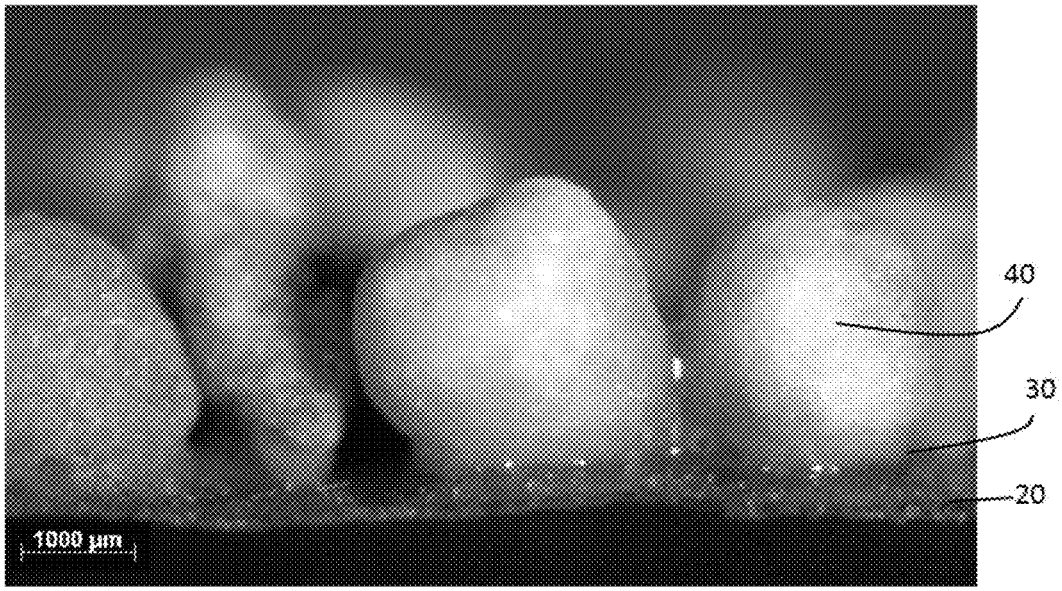
FIG. 3 is an optical photomicrograph profile showing an example of target core particles used in the present invention.

FIG. 3 is an optical photomicrograph profile showing target cores 40, backing 20 and pre-make 30. Also seen are valleys 11 and peaks 12.

Figure 4:
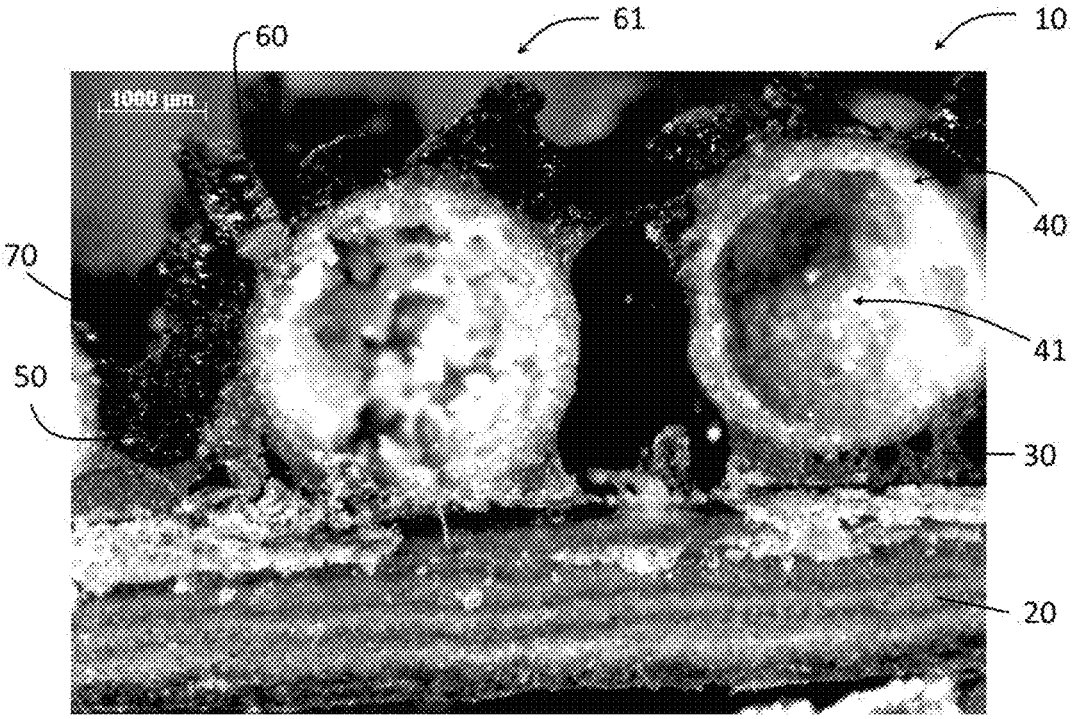
FIG. 4 is an enlarged optical photomicrograph profile representing the different parts comprising a coated abrasive of the present invention.

FIG. 4 is a cross-sectional side view of coated abrasive 10 of the present invention showing agglomerates 61, backing 20, pre-make 30 joining target cores 40 having porous centers 41 with the backing and make 50 joining abrasive particles 60 with target cores 40 forming agglomerates 61.

Figure 5:
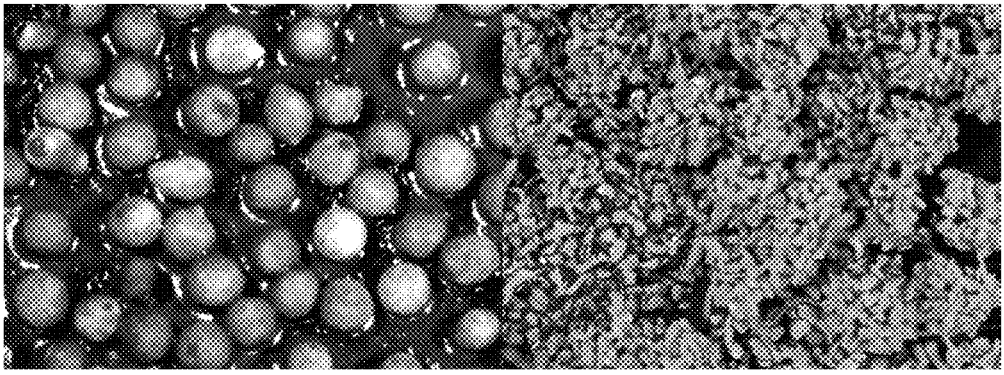
FIG. 5 is an optical photomicrograph showing target cores deposited on a textile backing and adhered by synthetic resins and agglomerated abrasive particles.

FIG. 5 is a top view of coated abrasive article 10 of the present invention before and after the abrasive grains have been deposited. Left picture (A) shows target core particles 40 deposited on backing 20 and pre-make 30. Also observed are valleys 11 between target cores 40. Meanwhile, right picture (B) shows abrasive particles 60 deposited by electro-projection on make coat 50 and valleys 11, and agglomerates 61 formed over target cores 40.

Figure 6:
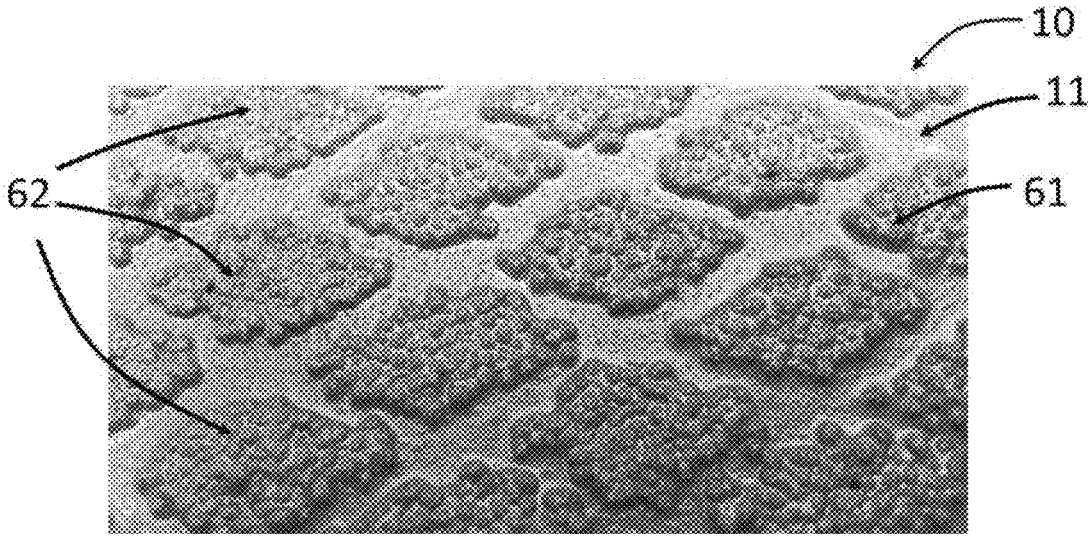
FIG. 6 is an optical photomicrograph showing cell patterns in such a way that the target cores and agglomerated abrasive particles will form shapes.

FIG. 6 is a top view of coated abrasive article 10 of the present invention where the target cores 40 and agglomerated abrasive particles 61 form shapes displaying cell patterns of replicated rhombuses 62.

Figure 7:
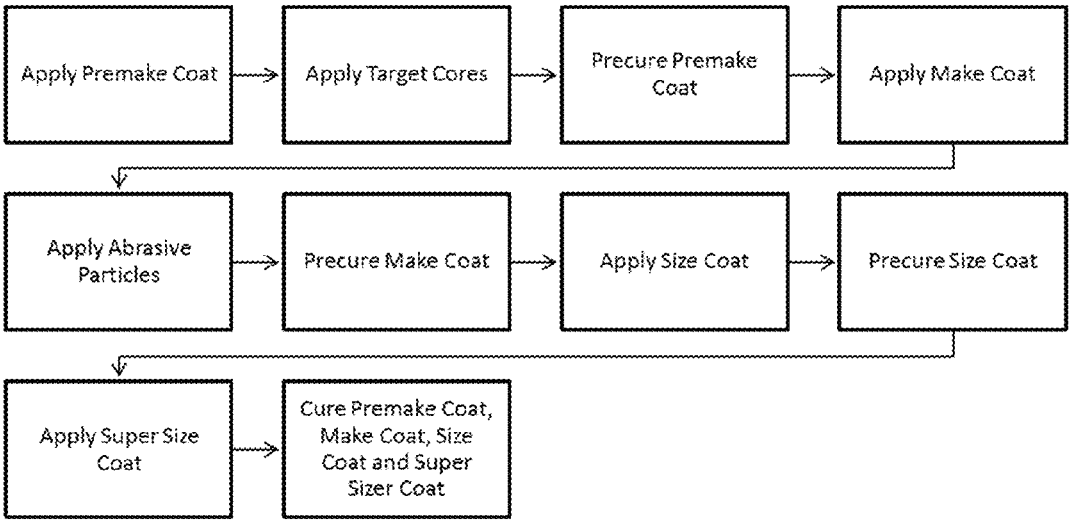
FIG. 7 is a schematic diagram of a method for manufacturing a coated abrasive article of the present invention.

FIG. 7 is a schematic flow diagram of the method of the present invention employing in situ agglomeration and illustrating the different steps in the process of the present invention for producing the agglomerates in situ.

Figure 8:
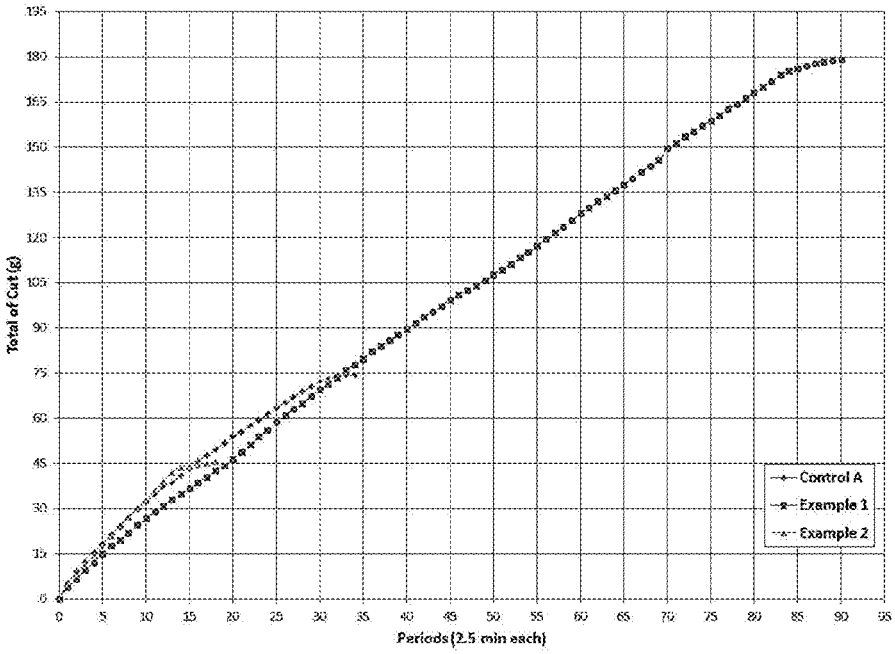
FIG. 8 is a graph of total cut in grams with respect to lifetime of the coated abrasive of Examples 1 and 2.

FIG. 8 is a graph illustrating the total cut in grams of Examples 1 and 2 of a coated abrasive article 10 of the present invention. FIG. 8 shows that the agglomerated abrasive has at least twice the cut efficiency of a conventional or mono-layer coated abrasive (Control A).

Figure 9:
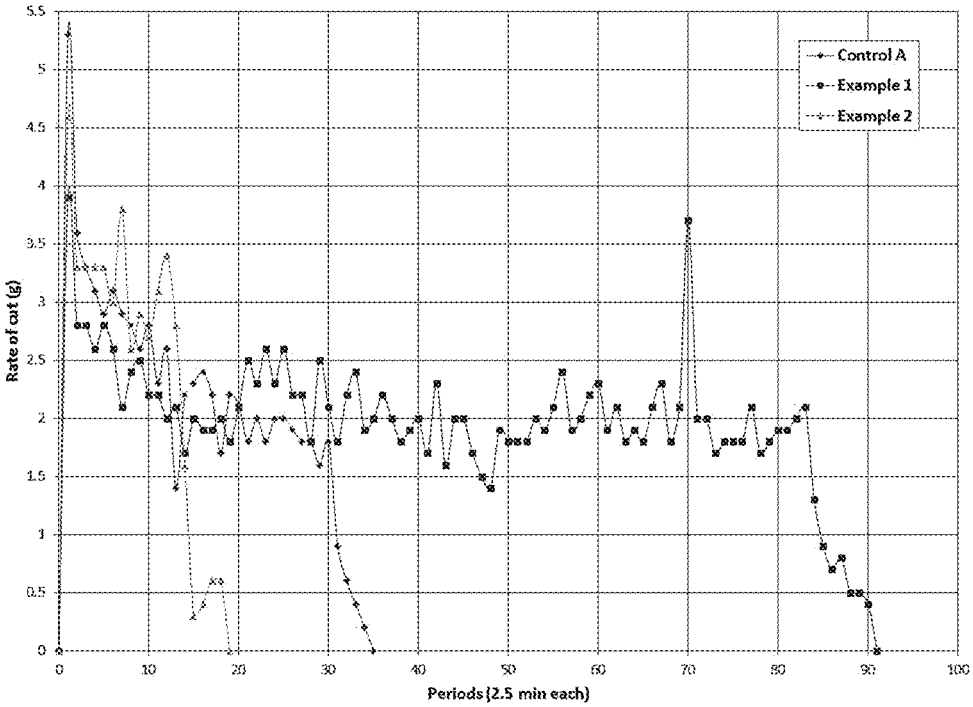
FIG. 9 is a graph of the cut profile with respect to time of the coated abrasive of Examples 1 and 2.

FIG. 9 is a graph illustrating the rate of cut in grams of Examples 1 and 2 of a coated abrasive article 10 of the present invention. FIG. 9 shows that the agglomerated abrasive exhibits a more consistent level of cut throughout the test sequence than a conventional or mono-layer coated abrasive (Control A).

Figure 10:
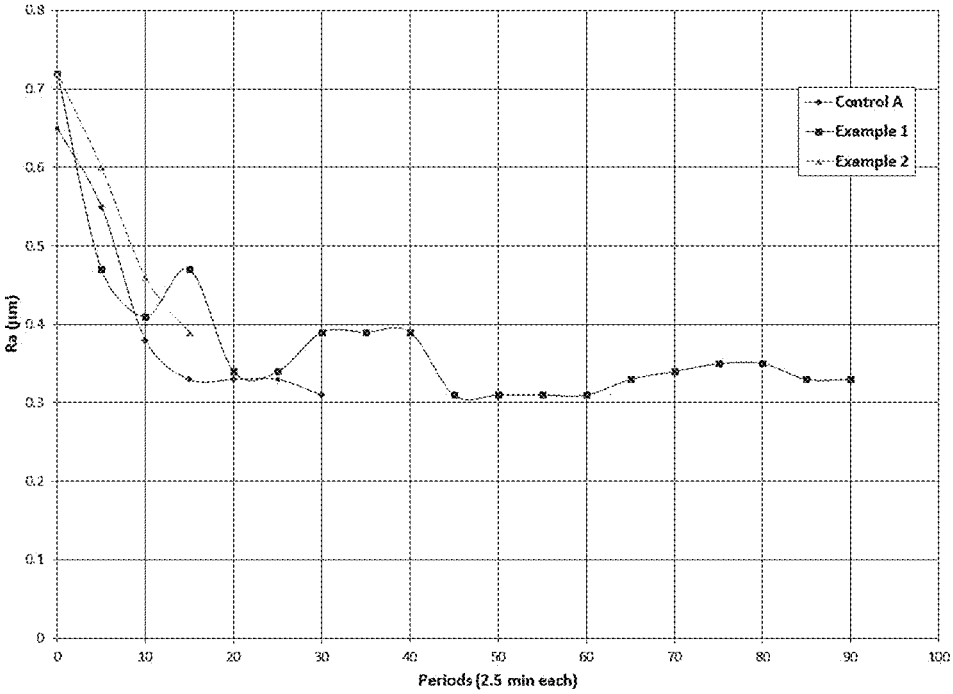
FIG. 10 is a graph of the roughness profile with respect to time of the coated abrasive of Examples 1 and 2.

FIG. 10 is a graph illustrating the roughness of the finished surface in microns (μm) when using Examples 1 and 2 of a coated abrasive article 10 of the present invention. FIG. 10 shows that the agglomerated abrasives of the present invention have similar performance in finished surface to a conventional or mono-layer coated abrasive (Control A).

Figure 11:
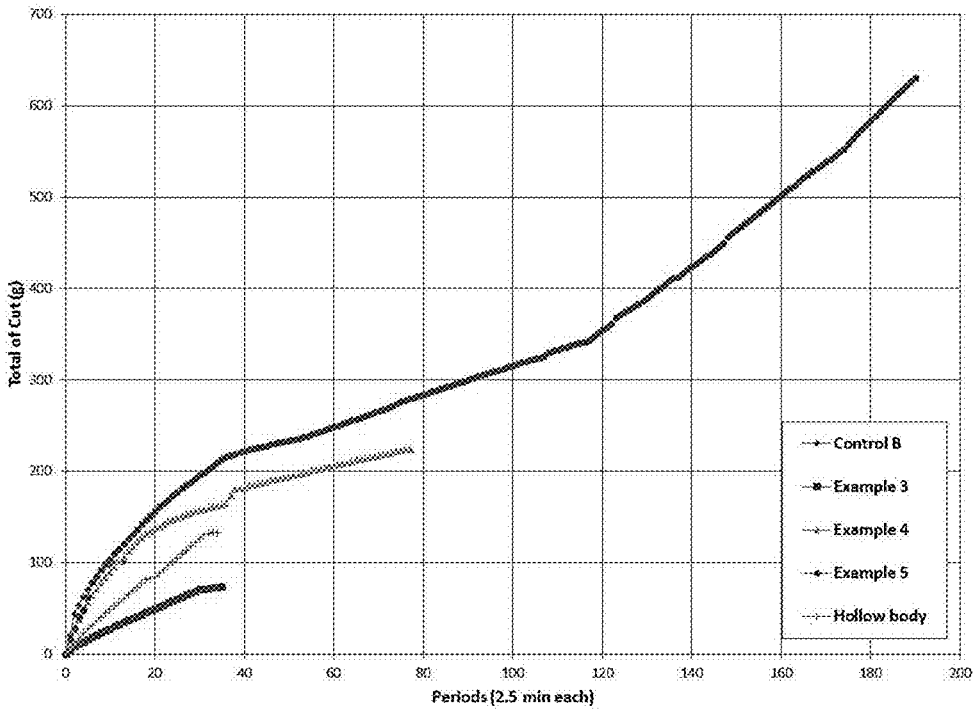
FIG. 11 is a graph of total cut in grams with respect to lifetime of the coated abrasive of Examples 3, 4 and 5.

FIG. 11 is a graph illustrating the total cut in grams of Examples 3, 4 and 5 of a coated abrasive article 10 of the present invention, of Control B and of a hollow-body agglomerate grain (U.S. Pat. No. 3,928,949). FIG. 11 shows that the agglomerated abrasives of the present invention have at least twice the cut efficiency of a conventional or mono-layer coated abrasive (Control B) or the hollow-body agglomerate grain of the '949 patent.

Figure 12:
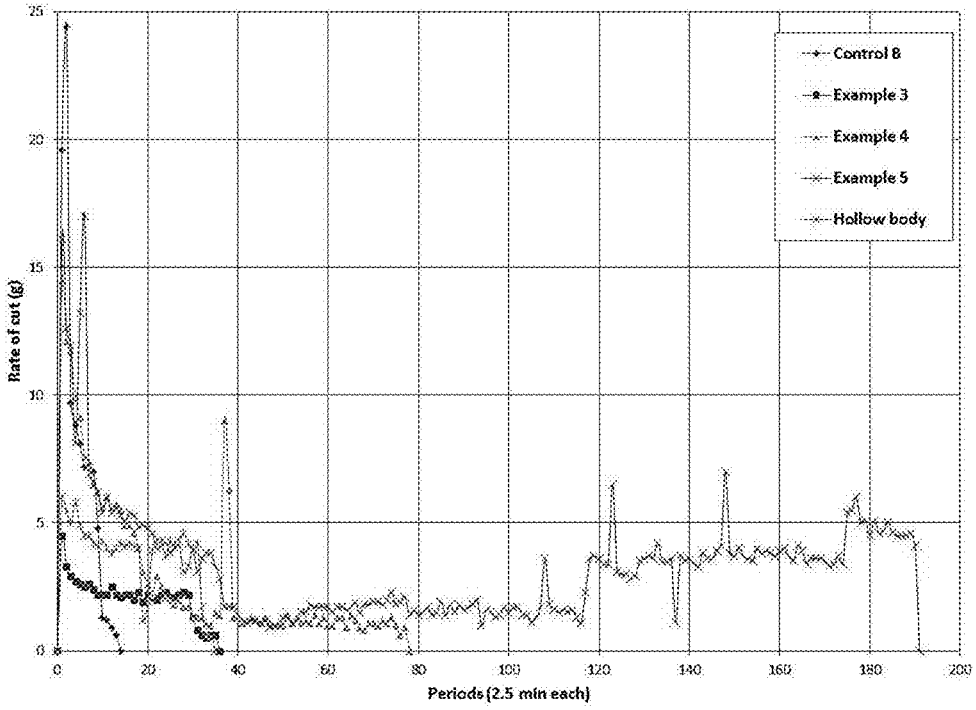
FIG. 12 is a graph of the cut profile with respect to time of the coated abrasive of Examples 3, 4 and 5.

FIG. 12 is a graph illustrating the rate of cut in grams of Examples 3, 4 and 5 of a coated abrasive article 10 of the present invention, of Control B and of a hollow-body agglomerate grain (U.S. Pat. No. 3,928,949). FIG. 12 shows that the agglomerated abrasives of the present invention exhibit a more consistent level of cut throughout the test sequence than the conventional or mono-layer coated abrasive (Control B) and the hollow-body agglomerate grain of the '949 patent.

Figure 13:
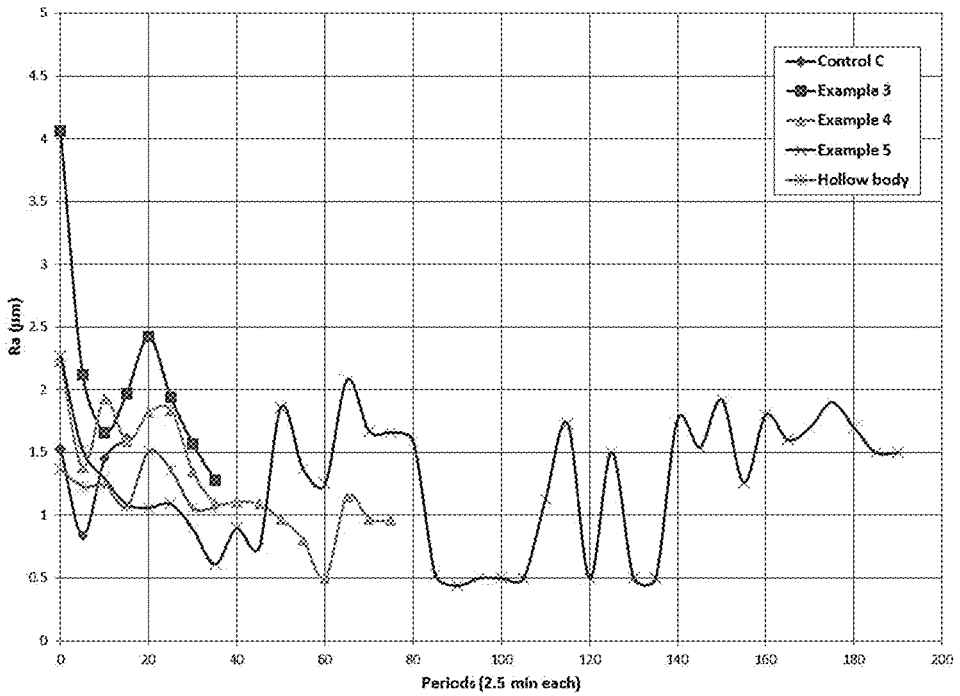
FIG. 13 is a graph of the roughness profile with respect to time of the coated abrasive of Examples 3, 4 and 5.

FIG. 13 is a graph illustrating the roughness of the finished surface in microns (μm) when using Examples 3, 4 and 5 of a coated abrasive article 10 of the present invention, of Control B and of a hollow-body agglomerate grain (U.S. Pat. No. 3,928,949). FIG. 13 shows that the agglomerated abrasives of the present invention have similar performance in finished surface to the conventional or mono-layer coated abrasive (Control B) and the hollow body agglomerate grain of the '949 patent.

Figure 14:
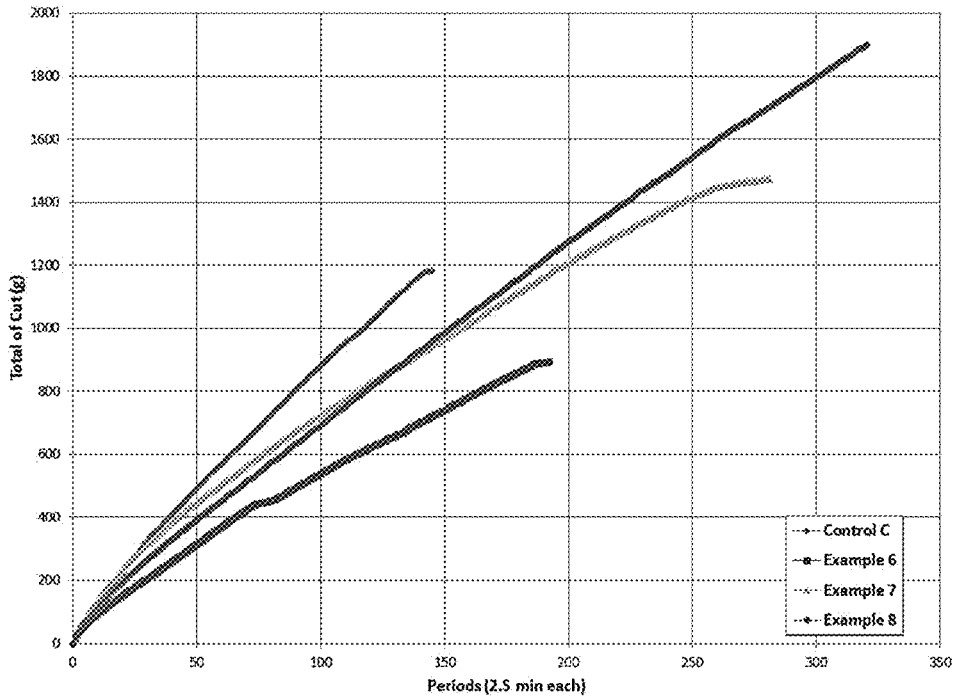
FIG. 14 is a graph of total cut in grams with respect to lifetime of the coated abrasive of Examples 6, 7 and 8.

FIG. 14 is a graph illustrating the total cut in grams of Examples 6, 7 and 8 of a coated abrasive article 10 of the present invention. FIG. 14 shows that the agglomerated abrasives of the present invention have at least twice the cut efficiency of a conventional or mono-layer coated abrasive (Control C).

Figure 15:
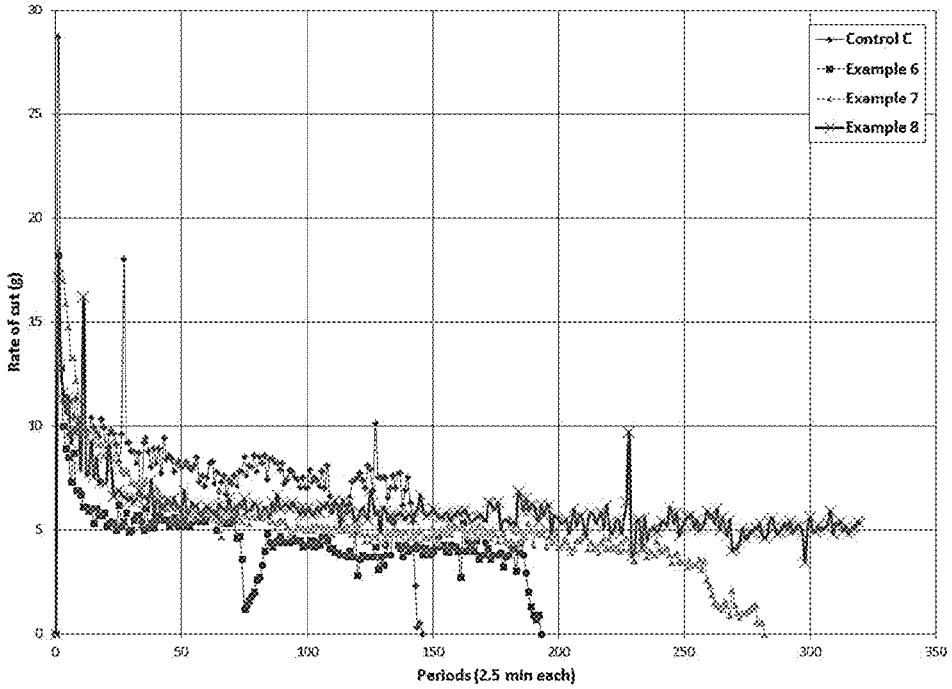
FIG. 15 is a graph of the cut profile with respect to time of the coated abrasive of Examples 6, 7 and 8.

FIG. 15 is a graph illustrating the rate of cut in grams of Examples 6, 7 and 8 of a coated abrasive article 10 of the present invention. FIG. 15 shows that the agglomerated abrasives of the present invention exhibit a more consistent level of cut throughout the test sequence than a conventional or mono-layer coated abrasive (Control C).

Figure 16:
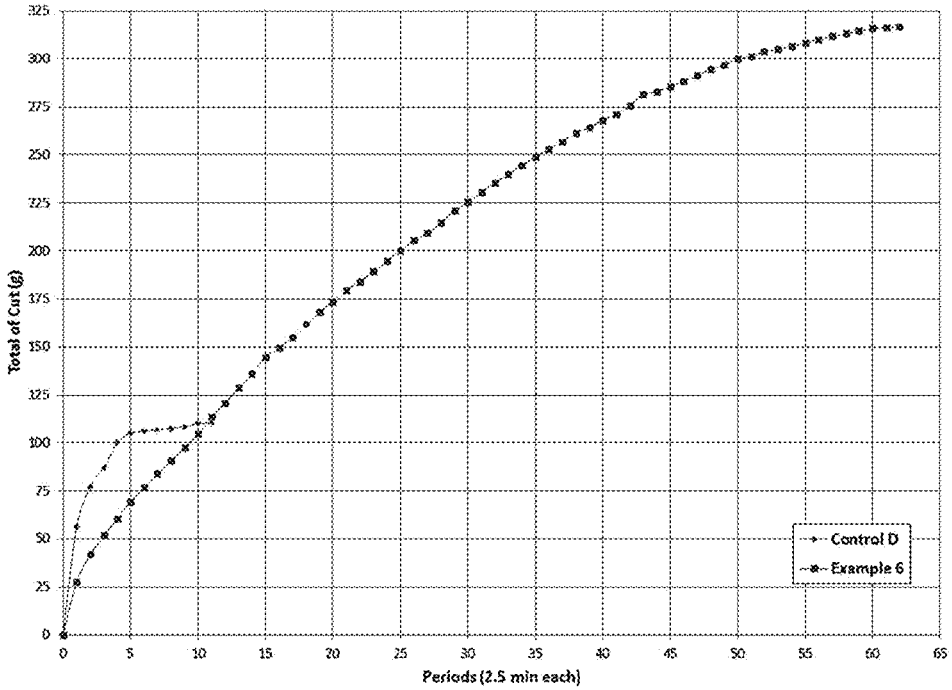
FIG. 16 is a graph of total cut in grams with respect to lifetime of the coated abrasive of Example 6 and Control C in 4 kg of pressure.

FIG. 16 is a graph illustrating the total cut in grams of Example 6 of a coated abrasive article 10 of the present invention using a higher work pressure (4 kg instead of 2 kg). FIG. 16 shows the effect of glassing on the agglomerated abrasive of the present invention at 2 kg of work pressure.

Figure 17:
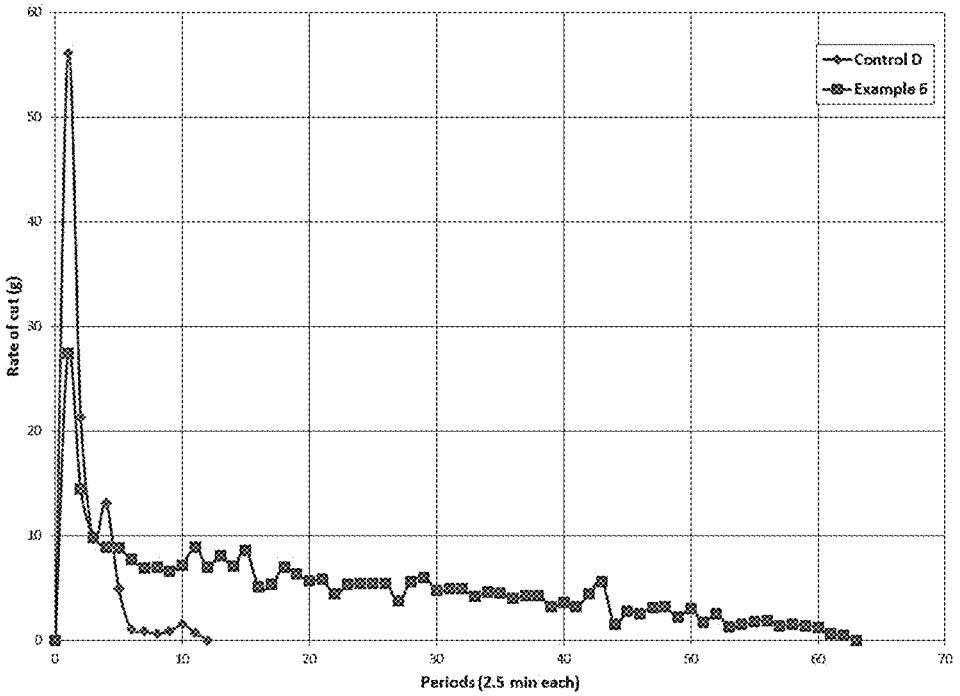
FIG. 17 is a graph of the cut profile with respect to time of the coated abrasive Examples 6 and Control C in 4 kg of pressure.

FIG. 17 is a graph illustrating the rate of cut in grams of Example 6 and Control C showing that the agglomerated abrasive 10 of the present invention exhibits a more consistent level of cut throughout the test sequence than the conventional or mono-layer coated abrasive (Control C).

Examples 1-8

Examples 1 to 8 of abrasive articles of the present invention were manufactured in accordance with the Specific Procedure for Making Coated Abrasives described above. These examples were tested in accordance with the Procedure for Testing Coated Abrasives (Belts) with the test results set forth in Table 2.

TABLE 2

| | | PREMAKE COAT | | TARGET CORES | | MAKE COAT | | ABRASIVE PARTICLES | | SIZE COAT | |
|---|---|---|---|---|---|---|---|---|---|---|---|
| DESIG-NATION | BACKING Type | Comp | Wt ($g/m^2$) | Type | Wt ($g/m^2$) | Comp | Wt ($g/m^2$) | Type | Wt ($g/m^2$) | Comp | Wt ($g/m^2$) |
| Example 1 | Polycotton 2 × 1 Cloth | 92% RF<br>01% IO<br>01% AL<br>06% $H_2O$ | 140 | SAA 0.2 mm | 100 | 92% RF<br>01% IO<br>01% AL<br>06% $H_2O$ | 70 | Grade 240 BSAO | 170 | 66% RF<br>02% IO<br>01% AL<br>28% CRY<br>03% $H_2O$ | 80 |
| Example 2 | Polycotton 2 × 1 Cloth | 92% RF<br>01% IO<br>01% AL<br>06% $H_2O$ | 140 | SAA 0.2 mm | 100 | 92% RF<br>01% IO<br>01% AL<br>06% $H_2O$ | 70 | Grade 240 BAO | 170 | 66% RF<br>02% IO<br>01% AL<br>28% CRY<br>03% $H_2O$ | 80 |
| Example 3 | Polycotton 2 × 1 Cloth | 92% RF<br>01% IO<br>01% AL<br>06% $H_2O$ | 270 | SAA 0.9 mm | 178 | 92% RF<br>01% IO<br>01% AL<br>06% $H_2O$ | 150 | N/A | N/A | 66% RF<br>02% IO<br>01% AL<br>28% CRY<br>03% $H_2O$ | 137 |
| Example 4 | Polycotton 2 × 1 Cloth | 92% RF<br>01% IO<br>01% AL<br>06% $H_2O$ | 270 | SAA 0.9 mm | 178 | 92% RF<br>01% IO<br>01% AL<br>06% $H_2O$ | 150 | Grade 120 CAO | 550 | 66% RF<br>02% IO<br>01% AL<br>28% CRY<br>03% $H_2O$ | 137 |
| Example 5 | Polycotton 2 × 1 Cloth | 92% RF<br>01% IO<br>01% AL<br>06% $H_2O$ | 270 | SAA 0.9 mm | 178 | 92% RF<br>01% IO<br>01% AL<br>06% $H_2O$ | 150 | Grade 120 BAO | 550 | 66% RF<br>02% IO<br>01% AL<br>28% CRY<br>03% $H_2O$ | 137 |
| Example 6 | Polyester 4 × 1 Cloth | 55% RF<br>37% $CaCO_3$<br>01% IO<br>01% AL | 400 | SAA 1.8 mm | 510 | 55% RF<br>37% $CaCO_3$<br>01% IO<br>01% AL | 400 | Grade 050 RBAO | 850 | 55% RF<br>37% $CaCO_3$<br>01% IO<br>01% AL | 300 |

TABLE 2-continued

| DESIG-NATION | BACKING Type | PREMAKE COAT Comp | Wt ($g/m^2$) | TARGET CORES Type | Wt ($g/m^2$) | MAKE COAT Comp | Wt ($g/m^2$) | ABRASIVE PARTICLES Type | Wt ($g/m^2$) | SIZE COAT Comp | Wt ($g/m^2$) |
|---|---|---|---|---|---|---|---|---|---|---|---|
| | | 06% $H_2O$ | | | | 06% $H_2O$ | | | | 06% $H_2O$ | |
| Example 7 | Polyester | 55% RF | 400 | SAA 1.8 mm | 510 | 55% RF | 400 | Grade 050 AZA | 850 | 55% RF | 300 |
| | 4 × 1 Cloth | 37% $CaCO_3$ | | | | 37% $CaCO_3$ | | | | 37% $CaCO_3$ | |
| | | 01% IO | | | | 01% IO | | | | 01% IO | |
| | | 01% AL | | | | 01% AL | | | | 01% AL | |
| | | 06% $H_2O$ | | | | 06% $H_2O$ | | | | 06% $H_2O$ | |
| Example 8 | Polyester | 55% RF | 400 | SAA 1.8 mm | 510 | 55% RF | 400 | Grade 050 BAO | 850 | 55% RF | 300 |
| | 4 × 1 Cloth | 37% $CaCO_3$ | | | | 37% $CaCO_3$ | | | | 37% $CaCO_3$ | |
| | | 01% IO | | | | 01% IO | | | | 01% IO | |
| | | 01% AL | | | | 01% AL | | | | 01% AL | |
| | | 06% $H_2O$ | | | | 06% $H_2O$ | | | | 06% $H_2O$ | |

Comparison of Examples 1 to 8 with Controls A to C

The abrasive articles of the comparative examples (Controls A to C) are conventional, coated abrasive belts commercially available from Fabrica Nacional de Lija S. A de C. V ("Fandeli") under the designation "R-88" in grade P240, P120 and 050, respectively. The coated abrasives prepared in Examples 1 through 8 were tested according to the procedure for testing coated abrasive in belt form outlined above.

Table 3 below displays the results of durability testing of Control A (R-88 P240) and Examples 1 and 2 and shows the sum of the number of periods achieved during the tests. Durability can also be measured by the total amount of metal removed.

TABLE 3

| DURABILITY | | |
|---|---|---|
| Abrasive Article | Abrading Periods | % of Control |
| Control A | 34 | 100 |
| Example 1 | 90 | 265 |
| Example 2 | 18 | 53 |

An abrasive article of the present invention with target cores having agglomerates prepared in situ (Example 1) was more than twice as durable as a conventional abrasive article as shown in Table 3 and FIGS. 8 and 9. The abrasive article with target cores having agglomerates prepared in situ was able to abrade the work piece during many more periods than the conventional abrasive article. Example 2 was less durable than Control A, because Example 2 exhibited a premature glassing at these conditions due to the toughness of the abrasive employed in producing the agglomeration.

Table 4 displays the total cut and surface roughness values produced with Control Sample A and Examples 1 and 2.

TABLE 4

| Abrasive Article | Initial Cut (g) | Total Cut (g) | % of Control | Initial Ra (μm) | Final Ra (μm) |
|---|---|---|---|---|---|
| Control A | 28.7 | 1182.1 | 100 | 0.65 | 0.31 |
| Example 1 | 18.2 | 894 | 76 | 0.72 | 0.33 |
| Example 2 | 12.9 | 1473.2 | 125 | 0.72 | 0.36 |

Abrasive products made by the present invention improve the consistency of the cut and finish performance when compared to conventional abrasive articles. Control A provides a high level of initial cut, but decreases in cut as the product is used. See FIG. 9. In contrast, Example 1 exhibits a more consistent level of cut throughout the test sequence, while Example 2 again clearly shows premature glassing. Both examples exhibit the same type of finish as the conventional abrasive (Control A). Thus, the agglomeration of the present invention does not affect the quality of the finished product as shown in FIG. 10.

Durability of Control B (R-88 P120) and Examples 3 to 5 are displayed in Table 5 which shows the sum of the number of periods achieved during the test. Durability can also be measured by the total amount of metal removed.

TABLE 5

| DURABILITY | | |
|---|---|---|
| Abrasive Article | Abrading Periods | % of Control |
| Control B | 13 | 100 |
| Example 3 | 35 | 269 |
| Example 4 | 77 | 592 |
| Example 5 | 190 | 1462 |
| Hollow Body (U.S. Pat. No. 3,928,949) | 34 | 262 |

Abrasive articles of the present invention with target cores and agglomerates prepared in situ (Examples 3, 4 and 5) were more than twice as durable as a conventional abrasive article as shown in Table 5 and FIGS. 11 and 12. Example 3 confirms the abrading capacity of the target cores. Examples 3, 4 and 5 were able to abrade the work piece for many more periods than the conventional abrasive article (Control B). Examples 4 and 5 displayed more than 5 times the abrading capacity of the control. Comparison with another agglomerate grain (the hollow body of U.S. Pat. No. 3,928,949) shows that the examples of the present invention were at least twice as durable as those prepared using the technology of the prior art '949 patent.

Table 6 displays the total cut and surface roughness values produced from Control B and Examples 3, 4 and 5.

TABLE 6

| Abrasive Article | Initial Cut (g) | Total Cut (g) | % of Control | Initial Ra (μm) | Final Ra (μm) |
|---|---|---|---|---|---|
| Control B | 19.6 | 100.9 | 100.00 | 1.53 | 1.61 |
| Example 3 | 4.5 | 73.6 | 72.94 | 4.06 | 1.28 |
| Example 4 | 14.5 | 224.5 | 222.50 | 2.23 | 0.96 |

TABLE 6-continued

| Abrasive Article | Initial Cut (g) | Total Cut (g) | % of Control | Initial Ra (μm) | Final Ra (μm) |
|---|---|---|---|---|---|
| Example 5 | 16.1 | 630.6 | 624.98 | 2.27 | 1.5 |
| Hollow Body (U.S. Pat. No. 3,928,949) | 6 | 133 | 131.81 | 1.37 | 1.06 |

The abrasive products of the present invention improve the consistency of the cut and finish performance, when compared with conventional abrasive articles such as Control B and those prepared using the hollow body technology of the '949 patent.

Control B produces a high level of initial cut, but decreases in cut as the product is used. See FIG. 12. In contrast, Examples 4 and 5 exhibit a more consistent level of cut throughout the test sequence. Example 4 was less durable than Example 5, because at the test conditions the ceramic grain is fouled due to glassing, so this kind of particle needs more work pressure to show a better performance. Comparison with another agglomerate grain (the hollow body of U.S. Pat. No. 3,928,949) shows that the examples of the present invention were more than twice as durable as those prepared using the technology of the '949 patent. All of the examples produce similar finishes when compared to the conventional abrasive of Control B, demonstrating that the in situ agglomeration of the present invention does not affect the quality of the final finish as shown in FIG. 13.

The results of durability testing of Control C (R-88 050) and Examples 6, 7 and 8 are displayed in Table 7 which shows the sum of the number of periods achieved during the tests. Durability can also be measured by the total amount of metal removed.

TABLE 7

| DURABILITY | | |
|---|---|---|
| Abrasive Article | Abrading Periods | % of Control |
| Control C | 145 | 100 |
| Example 6 | 192 | 132 |
| Example 7 | 281 | 194 |
| Example 8 | 320 | 221 |

An abrasive article of the present invention with target cores and agglomerates formed in situ (Examples 6, 7 and 8) were more than twice as durable as a conventional abrasive article as shown in Table 7 and FIGS. 14 and 15. Examples 6, 7 and 8 were able to abrade the work piece for many more periods than a conventional abrasive article (Control C).

Table 8 displays the total cut and surface roughness values obtained from Control C and Examples 6, 7 and 8.

TABLE 8

| Abrasive Article | Initial Cut (g) | Total Cut (g) | % of Control |
|---|---|---|---|
| Control C | 28.7 | 1182.1 | 100 |
| Example 6 | 18.2 | 894 | 76 |
| Example 7 | 12.9 | 1473.2 | 125 |
| Example 8 | 17.2 | 1901.5 | 161 |

The results demonstrate that abrasive products of the present invention improve the consistency of the cut and finish performance, when compared to conventional abrasive articles. Only Example 6 was less durable than Control C, because the abrasive particle exhibited glassing.

Control C shows a high level of initial cut, but decreases in cut as the product is used (See FIG. 15.), while Examples 6, 7 and 8 exhibit a more consistent level of cut throughout the test sequence. Example 6 was less durable than the other examples and Control C, because at the test conditions the brown grain is fouled by glassing. Accordingly, this kind of particle needs more work pressure to exhibit a better performance.

To demonstrate that the brown grain needs more work pressure, the procedure for testing coated abrasives in belt form was modified to increase the work pressure from 2 kg to 4 kg. Table 9 displays the durability results of Control C and Example 6 by the number of abrading periods achieved during the tests. Durability can also be measured by the total amount of metal removed.

TABLE 9

| DURABILITY | | |
|---|---|---|
| Abrasive Article | Abrading Periods | % of Control |
| Control C | 11 | 100 |
| Example 6 | 62 | 564 |

Example 6 shows significantly improved performance with the higher work pressure resulting in its durability being at least 5 times the durability of Control C. See also FIG. 16. Table 10 displays the total cut values obtained by Control C and Example 6 with the 4 kg work pressure.

TABLE 10

| Abrasive Article | Initial Cut (g) | Total Cut (g) | % of Control |
|---|---|---|---|
| Control C | 56.1 | 110.6 | 100 |
| Example 6 | 27.4 | 317 | 286 |

As shown in Table 10, Example 6 was more than twice as durable as and more efficient than a conventional abrasive article (Control C). While Control C demonstrates a high level of initial cut, the rate of cut decreases as the product is used (See FIG. 17.), while Example 6 exhibits a more consistent level of cut throughout the test sequence.

The foregoing description has been directed in primary part to a particular preferred embodiment in accord with the requirements of the Patent Statutes and for purposes of explanation and illustration. It will be apparent, however, to those skilled in the art that many modifications and changes in the specifically described abrasive articles and methods of making the same with in situ formation of the agglomerates may be made without departing from the true scope and spirit of the invention. For example, while the invention has been described using gravity-dispersed target cores, in an alternative method electrostatic methods may be used to better align the target cores. Because many such variations can be made, the invention is not restricted to the preferred embodiments described and illustrated but covers all modifications which may fall within the scope of the following claims.

We claim:

1. A coated abrasive article, comprising:

a backing having a major surface;

a plurality of agglomerates adhered to said major surface, said agglomerates formed in situ on said backing during the process of manufacturing said coated abrasive article by nucleation of a plurality of abrasive particles on a plurality of target cores previously adhered to said major surface of said backing, said target cores being porous structures having an abrasive capacity as a grinding aid element; and a pre-make, a make and a size coat, each said coat comprising an organic resin, wherein said pre-make and make coats bind said target cores to said working surface of said backing and wherein said make and size coats bind said abrasive particles to said target cores to form said agglomerates.

2. The coated abrasive article of claim 1 further comprising a top coat over said size coat.

3. The coated abrasive article of claim 1 wherein said target cores range is size from about 50 to about 5000 microns, said abrasive particles range is size from about 3 to about 2000 microns and the size ratio of said target cores to said abrasive particles is about 1-3:1.

4. The coated abrasive article of claim 1 wherein said target cores are in the form of shaped structures selected from the group consisting of spheres, cylinders, cubes, pyramids, tetrahedrons and other polyhedral shapes.

5. The coated abrasive article of claim 1 wherein said target cores are selected from the group consisting of alpha alumina with different percentages of alpha alumina between about 95% to about 99.9%, alumina zirconia, silica, titanium dioxide, glass, micro natural stones, polyethylene, polypropylene, polystyrene, other polymers and materials having a hardness of at least about 4 on Mohs scale and mixtures thereof.

6. The coated abrasive article of claim 1 wherein said abrasive particles are selected from the group consisting of fused brown and white aluminum oxide, heat treated aluminum oxide, silicon carbide, zirconia alumina, ceramic aluminum oxide, cubic boron nitride, garnet, gypsum, talc, calcium oxide, aluminum oxide, calcium silicate, glass bubbles, gypsum, talc, calcium oxide, aluminum oxide, calcium silicate, diatomaceous earths, materials having a hardness of at least about 7 on Mohs scale and mixtures thereof.

7. The coated abrasive article of claim 1 wherein said agglomerates are distributed on said backing in regular cell patterns forming shapes selected from the group consisting of circles, ellipses, triangles, squares, rectangles, rhombuses, other polygonal shapes and combinations thereof.

8. The coated abrasive article of claim 1 wherein said pre-make, make and size coats are selected from the group consisting of phenolic resins, urea-formaldehyde resins, melamine-formaldehyde resins, epoxy resins, acrylic resins, urethane resins, alkyd resins and mixtures thereof and may be the same or different.

9. The coated abrasive article of claim 1 wherein:

said backing is selected from the group consisting of treated textile fabrics made from natural and synthetic yarns, vulcanized fibers, non-wovens, papers, saturated papers, polymeric extruded films, polymeric foams, paper/cloth combinations, mesh, stitch-bonded and combinations thereof;

said target cores are selected from the group consisting of alpha alumina with different percentages of alpha alumina between about 95% to about 99.9%, alumina zirconia, silica, titanium dioxide, glass, micro natural stones, polyethylene, polypropylene, polystyrene, other polymers and materials having a hardness of at least about 4 on Mohs scale and mixtures thereof; and said abrasive particles are selected from the group consisting of fused brown and white aluminum oxide, heat treated aluminum oxide, silicon carbide, zirconia alumina, ceramic aluminum oxide, cubic boron nitride, garnet, gypsum, talc, calcium oxide, aluminum oxide, calcium silicate, glass bubbles, gypsum, talc, calcium oxide, aluminum oxide, calcium silicate, diatomaceous earths, other materials having a hardness of at least about 7 on Mohs scale and mixtures thereof; and said pre-make, make and size coats are each selected from the group consisting of phenolic resins, urea-formaldehyde resins, melamine-formaldehyde resins, epoxy resins, acrylic resins, urethane resins, alkyd resins and mixtures thereof and may be the same or different, wherein said pre-make and make coats bind said target cores to said working surface of said backing and wherein said make and size coats bind said abrasive particles to said target cores to form said agglomerates.

10. A method for manufacturing a coated abrasive article, comprising:

selecting a backing having a first surface;

applying to said first surface a pre-make coat comprising an organic resin;

depositing a plurality of target cores onto said resin-coated first surface;

at least partially curing said pre-make coat to adhere said target cores to said backing;

applying a make coat comprising an organic resin over said at least partially cured pre-make coat, said target cores and said backing;

depositing a plurality of abrasive particles onto said make coat;

at least partially curing said make coat to form a plurality of agglomerates in situ on said first surface of said backing by nucleation of said abrasive particles on said target cores previously adhered to said backing;

applying a size coat comprising an organic resin over said at least partially cured make coat and agglomerates; and curing said size, make and pre-make coats.

11. The method of claim 10 further comprising applying a top coat over said size coat and curing said top coat.

12. The method of claim 10 wherein said target cores are in the form of shaped structures selected from the group consisting of spheres, cylinders, cubes, pyramids, tetrahedrons and other polyhedral shapes.

13. The method of claim 10 wherein said target cores are selected from the group consisting of alpha alumina with different percentages of alpha alumina between about 95% to about 99.9%, alumina zirconia, silica, titanium dioxide, glass, micro natural stones, polyethylene, polypropylene, polystyrene, other polymers and materials having a hardness of at least about 4 on Mohs scale and mixtures thereof and wherein said target cores range in size from about 50 to about 5000 microns.

14. The method of claim 13 wherein said abrasive particles are selected from the group consisting of fused brown and white aluminum oxide, heat treated aluminum oxide, silicon carbide, zirconia alumina, ceramic aluminum oxide, cubic boron nitride, garnet, gypsum, talc, calcium oxide, aluminum oxide, calcium silicate, glass bubbles, gypsum, talc, calcium oxide, aluminum oxide, calcium silicate, diatomaceous earths, materials having a hardness of at least about 7 on Mohs scale and mixtures thereof and wherein said abrasive particles range is size from about 3 to about 2000 microns and the size ratio of said target cores to said abrasive particles is about 1-3:1.

15. The method of claim 14 wherein said pre-make, make and size coats are selected from the group consisting of phenolic resins, urea-formaldehyde resins, melamine-formaldehyde resins, epoxy resins, acrylic resins, urethane resins, alkyd resins and mixtures thereof and may be the same or different.

16. The method of claim 10 wherein said target cores and said abrasive particles are deposited using a method selected from the group consisting of gravity and electrostatic deposition methods and may be the same or different.

17. The method of claim 10 wherein said agglomerates are distributed on said backing in regular cell patterns forming shapes selected from the group consisting of circles, ellipses, triangles, squares, rectangles, rhombuses, other polygonal shapes and combinations thereof.

18. The method of claim 10 wherein said pre-make, make and size coats are applied by a technique selected from the group consisting of spray coating, roll coating, die coating, powder coating, curtain coating and knife coating.

19. The method of claim 10 wherein said curing is achieve by subjecting said abrasive article to an energy source selected from the group comprising heat transfer, ultraviolet light or an electron beam.

20. The method of claim 19 wherein said curing is achieved by heating to a temperature of about 60° C. to about 150° C.

21. A coated abrasive article made by a process, comprising:

selecting a backing having a first surface;

applying to said first surface a pre-make coat comprising an organic resin;

depositing a plurality of target cores onto said resin-coated first surface;

at least partially curing said pre-make coat to adhere said target cores to said backing;

applying a make coat comprising an organic resin over said at least partially cured pre-make coat, said target cores and said backing;

depositing a plurality of abrasive particles onto said make coat;

at least partially curing said make coat to form a plurality of agglomerates in situ on said first surface of said backing by nucleation of said abrasive particles on said target cores previously adhered to said backing;

applying a size coat comprising an organic resin over said at least partially cured make coat and agglomerates; and curing said size, make and pre-make coats.

22. The coated abrasive article of claim 21 wherein said process further comprises applying a top coat over said size coat and curing said top coat.

23. The coated abrasive article of claim 21 wherein said target cores range is size from about 50 to about 5000 microns, said abrasive particles range is size from about 3 to about 2000 microns and the size ratio of said target cores to said abrasive particles is about 1-3:1.

24. The coated abrasive article of claim 21 wherein said target cores are in the form of shaped structures selected from the group consisting of spheres, cylinders, cubes, pyramids, tetrahedrons and other polyhedral shapes.

25. The coated abrasive article of claim 21 wherein said target cores are selected from the group consisting of alpha alumina with different percentages of alpha alumina between about 95% to about 99.9%, alumina zirconia, silica, titanium dioxide, glass, micro natural stones, polyethylene, polypropylene, polystyrene, other polymers and materials having a hardness of at least about 4 on Mohs scale and mixtures thereof and wherein said target cores range in size from about 50 to about 5000 micronsw.

26. The coated abrasive article of claim 25 wherein said abrasive particles are selected from the group consisting of fused brown and white aluminum oxide, heat treated aluminum oxide, silicon carbide, zirconia alumina, ceramic aluminum oxide, cubic boron nitride, garnet, gypsum, talc, calcium oxide, aluminum oxide, calcium silicate, glass bubbles, gypsum, talc, calcium oxide, aluminum oxide, calcium silicate, diatomaceous earths, materials having a hardness of at least about 7 on Mohs scale and mixtures thereof and wherein said abrasive particles range is size from about 3 to about 2000 microns and the size ratio of said target cores to said abrasive particles is about 1-3:1.

27. The coated abrasive article of claim 26 wherein said pre-make, make and size coats are selected from the group consisting of phenolic resins, urea-formaldehyde resins, melamine-formaldehyde resins, epoxy resins, acrylic resins, urethane resins, alkyd resins and mixtures thereof and may be the same or different.

28. The coated abrasive article of claim 21 wherein said target cores and said abrasive particles are deposited using a method selected from the group consisting of gravity and electrostatic deposition methods and may be the same or different.

29. The coated abrasive article of claim 21 wherein said agglomerates are distributed on said backing in regular cell patterns forming shapes selected from the group consisting of circles, ellipses, triangles, squares, rectangles, rhombuses, other polygonal shapes and combinations thereof.

30. The coated abrasive article of claim 21 wherein said pre-make, make and size coats are applied by a technique selected from the group consisting of spray coating, roll coating, die coating, powder coating, curtain coating and knife coating.

31. The coated abrasive article of claim 21 wherein said curing is achieve by subjecting said abrasive article to an energy source selected from the group comprising heat transfer, ultraviolet light or an electron beam.

32. The coated abrasive article of claim 31 wherein said curing is achieved by heating to a temperature of about 60° C. to about 150° C.

* * * * *